US007527266B1

(12) United States Patent
Laiti

(10) Patent No.: US 7,527,266 B1
(45) Date of Patent: May 5, 2009

(54) MAZE GAME AND METHOD OF PLAY

(76) Inventor: Dominic Laiti, 17570 Deavers Ct., Hamilton, VA (US) 20158

( * ) Notice: Subject to any disclaimer, the term of this patent is extended or adjusted under 35 U.S.C. 154(b) by 9 days.

(21) Appl. No.: 11/713,850

(22) Filed: Mar. 5, 2007

(51) Int. Cl.
*A63F 3/00* (2006.01)

(52) U.S. Cl. ..... 273/282.1; 273/242

(58) Field of Classification Search ..... 273/242, 273/284, 243, 287, 282.1
See application file for complete search history.

(56) References Cited

U.S. PATENT DOCUMENTS 4,453,718 A * 6/1984 Christoperson ..... 273/249
4,817,957 A * 4/1989 Reeves ..... 273/248

FOREIGN PATENT DOCUMENTS

GB 2147509 A * 5/1985

* cited by examiner

*Primary Examiner*—Vishu K. Mendiratta
(74) *Attorney, Agent, or Firm*—Ted Masters

(57) ABSTRACT

A maze game for a plurality of players includes a plurality of rotatable gate members which may be rotated to reconfigure the maze. A first randomizer determines the number of playing stations a player's game piece moves, and a second randomizer determines the total number of one-quarter turns of the rotatable gate members.

16 Claims, 7 Drawing Sheets

MAZE GAME AND METHOD OF PLAY

TECHNICAL FIELD

The present invention pertains generally to games, and more particularly to a maze game in which the maze is reconfigured by the players during play.

BACKGROUND OF THE INVENTION

A maze typically comprises a structure having a starting point, a finish point, and a collection of complex branching passageway therebetween. A person tries to navigate the maze passageways from the starting point to the finish point. In a basic maze the walls or borders which define the maze passageways are fixed. In another type of maze, the walls and passageways of the maze are reconfigurable.

BRIEF SUMMARY OF THE INVENTION

The present invention is directed to a maze game for a plurality of players which includes a plurality of rotatable gate members which may be rotated to reconfigure the maze during play of the game. A first randomizer determines the number of playing stations a player's game piece moves, and a second randomizer determines the total number of one-quarter turns of the rotatable gate members. The game is typically played by two or more players, but can also be played by a single player.

In accordance with a preferred embodiment of the invention, a maze game for a plurality of players includes a game piece for each of the plurality of players, a playing area having (1) a plurality of playing stations arranged to from a grid, and (2) a plurality of rotatable gate members wherein each rotatable gate member rotates about a pivot point which is disposed at a junction of four playing stations, and each rotatable gate member includes at least one gate outwardly projecting from the pivot point.

In accordance with an aspect of the invention, at least one rotatable gate member has three gates, wherein two of the three gates are collinear and outwardly project in opposite directions, and a third gate is oriented perpendicular to the two collinear gates.

In accordance with another aspect of the invention, the playing stations are square and have four sides each side having a length L, and the gate also having a length L.

In accordance with another aspect of the invention, the pivot points for two adjacent rotatable gate members are disposed a distance of 2 L apart.

In accordance with another aspect of the invention, each rotatable gate member is rotatable to one of four positions, wherein each position is 90° from an adjacent position.

In accordance with another aspect of the invention, the playing area is rectangular, and has a start area disposed at one corner and a finish area disposed a the diagonally opposite corner.

In accordance with another aspect of the invention, a first randomizer determines the number of playing stations a game piece moves upon the playing area, and a second randomizer determines the amount of rotation of the rotatable gate members.

In accordance with another aspect of the invention, the second randomizer determines the total number of one-quarter turns which may be made by one or more rotatable gate members.

In accordance with another aspect of the invention, the second randomizer includes a six sided die having a representation of the number zero on one side, a representation of the number one on one side, a representation of the number two on two sides, a representation of the number three on one side, and a representation of the number four on one side.

In accordance with another aspect of the invention, at least one non-rotatable barricade is disposed upon the playing area at a junction of four playing stations. The barricade having four outwardly projecting gates which are spaced at 90° intervals and which are aligned with the grid.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
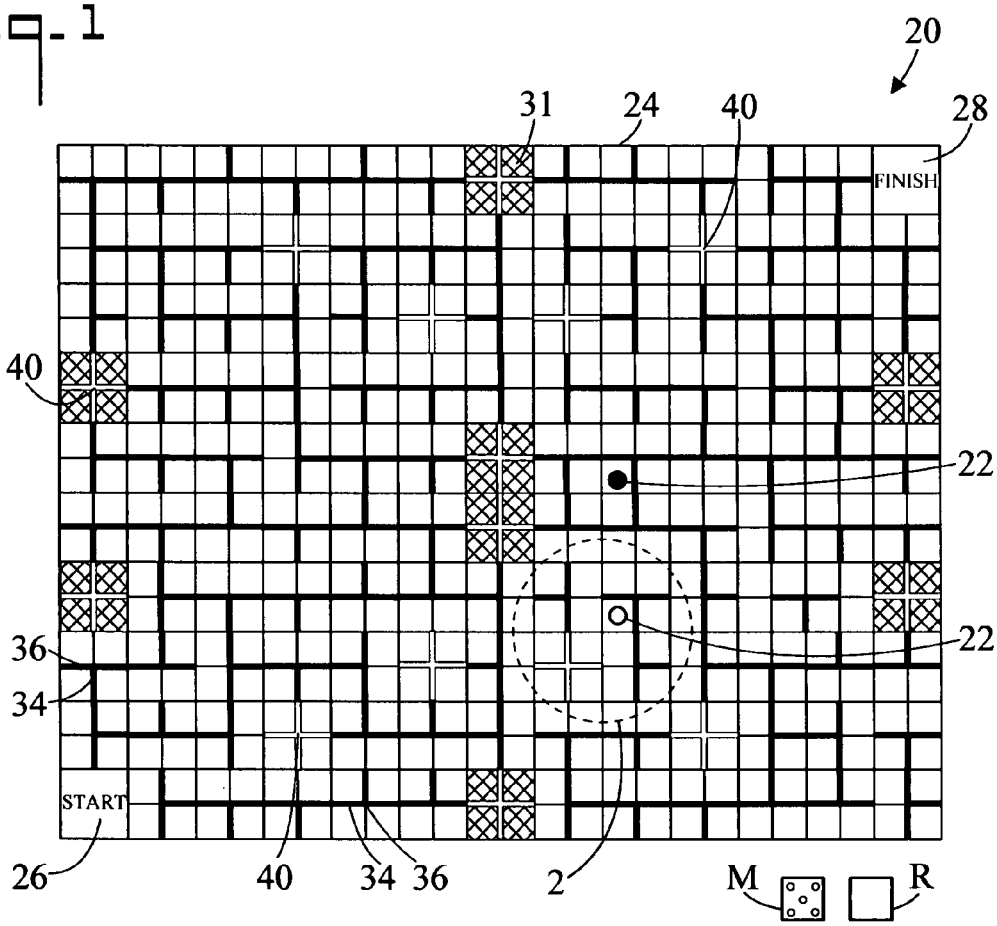
FIG. 1 is a top plan view of a maze game in accordance with the present invention.
Figure 2:
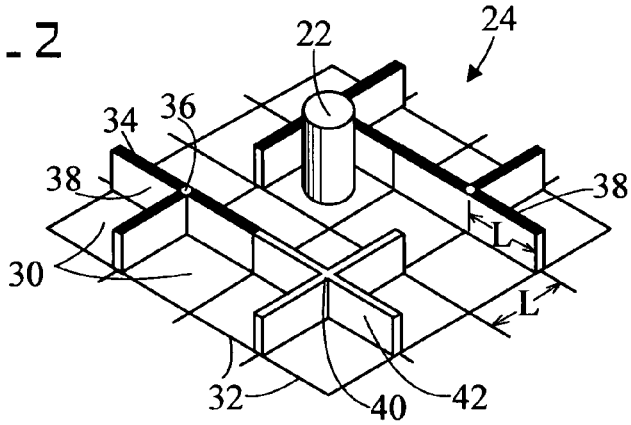
FIG. 2 is an enlarged perspective view of area 2 of FIG. 1.

Referring initially to FIG. 1, there is illustrated a top plan view of a maze game for a plurality of players in accordance with the present invention, generally designated 20. FIG. 2 is an enlarged perspective view of area 2 of FIG. 1. Maze game 20 includes a game piece 22 for each of the plurality of players. In an alternative embodiment, each player may have more than one game piece 22. Maze game 20 further includes a playing area 24 upon which game pieces 22 move. In the shown embodiment, playing area 24 is rectangular. A plurality of playing stations 30 are disposed upon playing area 24, playing stations 30 being arranged to form a grid. In the shown embodiment, playing stations 30 are square and have four sides 32 wherein each side 32 has a length L. Also in the shown embodiment, the grid is 26 playing stations 30 by 20 playing stations 30. A start area 26 is disposed at a corner of playing area 24, and a finish area 28 is disposed at a corner diagonally opposite start area 26. In the shown embodiment start area 26 and finish area 28 are each the size of four playing stations 30.

It may be appreciated that playing area 24 could be disposed on a game board, a gaming table, a playing cloth, a video game, a playstation, a bar top game, a slot machine, a TV set, a computer monitor, a portable hand held game, or any other useful playing surface. Accordingly, the various terms employed in the description to identify physical components, such as "a playing area", "playing station", and "game piece" should be taken to include electronic media equivalents. Additionally, the game of the present invention could be played between geographically remote players over the Internet.

A plurality of rotatable gate members 34 are disposed on playing area 24 wherein each rotatable gate member 34 rotates about a pivot point 36 (such as a pin or axle) which is disposed at a junction of four playing stations 30, and each rotatable gate member 34 includes at least one gate 38 which outwardly projects from pivot point 36. At least one (all in the shown embodiment) of the rotatable gate members 34 has three gates 38, wherein two of the three gates 38 are collinear and outwardly project in opposite directions, and a third gate 38 is oriented perpendicular to the two collinear gates 38. Gates 38 also have a length L equal to the length L of each side 32 of a playing station 30. The pivot points 36 for two adjacent rotatable gate members 34 are disposed a distance of 2 L apart. Each rotatable gate member 34 is rotatable to one of four positions, wherein each position is 90° from an adjacent position, and in each rotational position gates 38 are aligned with a side 32 of a playing station 30. In an embodiment of the invention, detents are provided which urge rotatable gate member 34 into each of the four rotational positions. In an embodiment of maze game 20, before the game starts the rotatable gate members 34 are arranged in a random rotational position. That is, maze game 20 is played with the rotatable gate members 34 in any random position (such as from the end of the last game).

At least one non-rotatable barricade 40 is disposed upon playing area 24. Each barricade 40 is disposed at a junction of four playing stations 30, and has four outwardly projecting gates 42 which are spaced at 90° intervals and which are aligned with the grid of playing stations 30 (i.e. a side 32 of a playing station 30). In the shown embodiment, there are 16 barricades 40. Eight of the barricades 40 are surrounded by extra turn playing stations 31 (hatched), wherein if a game piece 22 lands upon an extra turn playing station 31, the player receives and extra turn.

Maze game 20 further includes a first randomizer M for determining the number of playing stations 30 a game piece 22 moves upon playing area 24 in a player's turn. In an embodiment of the game, first randomizer M is a conventional die having the numbers one through six. Maze game 20 also includes a second randomizer R for determining the rotation of rotatable gate members 34. Second randomizer R determines a total number of one-quarter turns (90° rotations) which may be made by one or more rotatable gate members 34 in the player's turn. For example, if second randomizer R indicates two, then a player may rotate one rotatable gate member 34 two one-quarter turns (180°), or rotate two rotatable gate members 34 one-quarter turn each (90° each). Also referring to FIGS. 3 and 4, in an embodiment of the game second randomizer R is a six sided die having a representation of the number zero on one side (such as a blank side), a representation of the number one on one side, a representation of the number two on two sides, a representation of the number three on one side, and a representation of the number four on one side. Experience in play of the game has shown this very unique combination of die numbers to result in optimum play. In an embodiment of the game, second randomizer R is different color from first randomizer M (for example M could be red and R could be green).

While dice are used as randomizers M and R in the shown embodiment, it may be appreciated that other randomizers such as spinning wheels, random number generators, cards, or the like, could also be used to determine the number of playing stations 30 which a game piece 22 is moved, and the number of one-quarter turns of rotational gate members 34.

Figure 3:
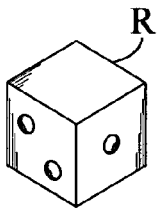
FIG. 3 is an enlarged top front perspective view of a second randomizer.
Figure 4:
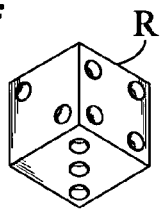
FIG. 4 is an enlarged bottom rear perspective view of the second randomizer.

FIGS. 3 and 4 are enlarged top front perspective and enlarged bottom rear perspective views respectively of second randomizer R, showing a side which is blank (zero), a side with a one, two sides with a two, a side with a three, and a side with a four.

Figure 5:
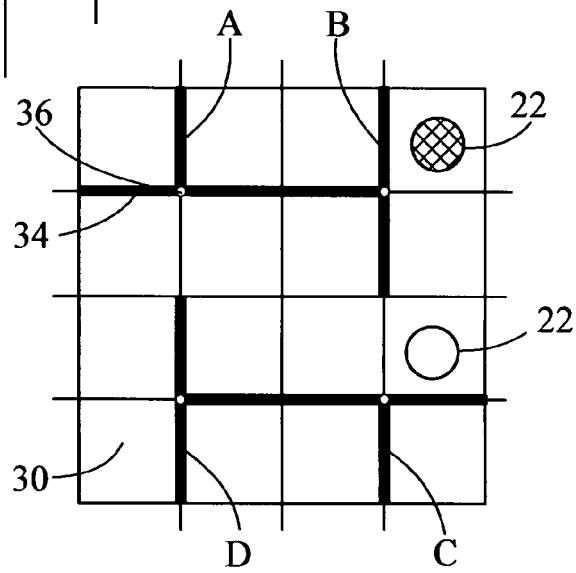
FIG. 5 is an enlarged fragmented top plan view of a playing area.

FIG. 5 is an enlarged fragmented top plan view of playing area 24 showing 16 playing stations 30, two game pieces 22 (white for one player and hatched for another player), and four rotatable gate members 34 and their four associated pivot points 36. For discussion purposes the four rotatable gate members 34 are labeled A, B, C, and D.

Figure 6:
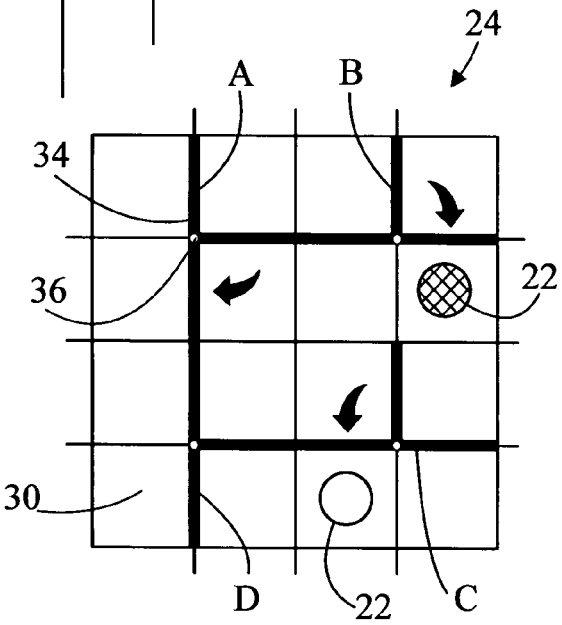
FIG. 6 is the playing area of FIG. 5 showing how rotatable gate members rotate.

FIG. 6 is the playing area of FIG. 5 showing how rotatable gate members 34 rotate. Rotatable gate member A has been rotated one-quarter turn (90°) clockwise. Rotatable gate member B has been rotated one-quarter turn clockwise. However, since a game piece 22 (hatched) was disposed in the path of rotatable gate member B, the game piece is moved by gate member B from its initial position in FIG. 5 to the position in FIG. 6. Rotatable gate member C has been rotated two-quarter turns (180°) counter-clockwise. As such, game piece 22 (white) has been moved from its initial position in FIG. 5 to the position in FIG. 6. Rotatable gate member D has not been rotated.

Figure 7:
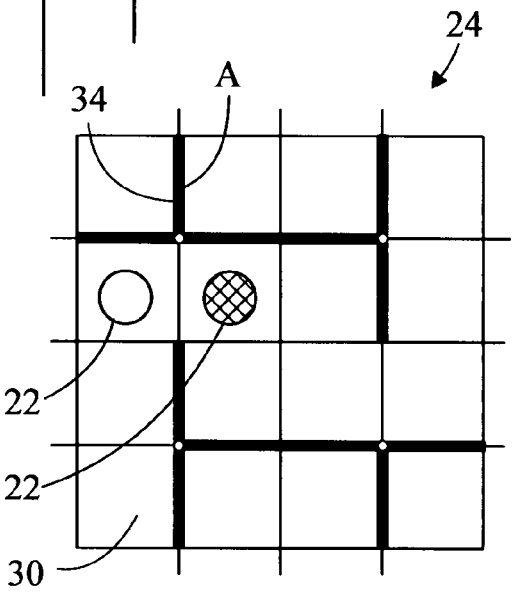
FIG. 7 is the playing area of FIG. 5 showing when a rotatable gate member may not rotate.

FIG. 7 is the playing area of FIG. 5 showing when a rotatable gate member 34 may not rotate. In the shown position, rotatable gate member A cannot rotate clockwise since game piece 22 (hatched) would be moved onto the same playing station occupied by game piece 22 (white), and a rule of the game is that no game piece 22 move can result in two game pieces 22 occupying the same playing station 30. For the same reason, rotatable gate member A also cannot rotate counter-clockwise.

Figure 8:
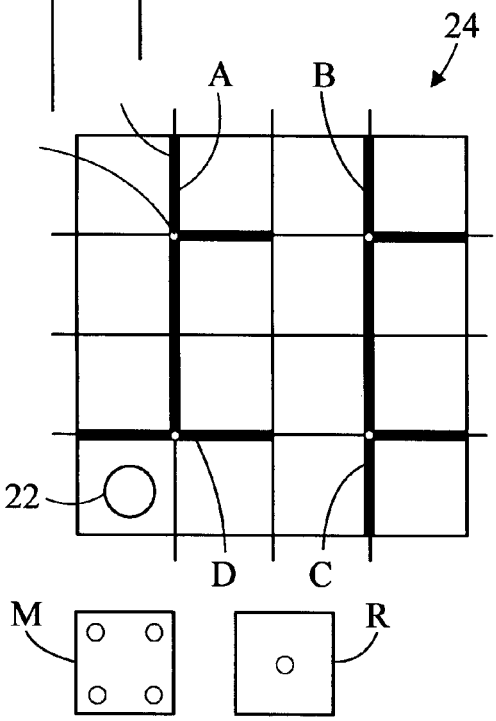
FIG. 8 is an enlarged fragmented top plan view of a playing area.
Figure 9:
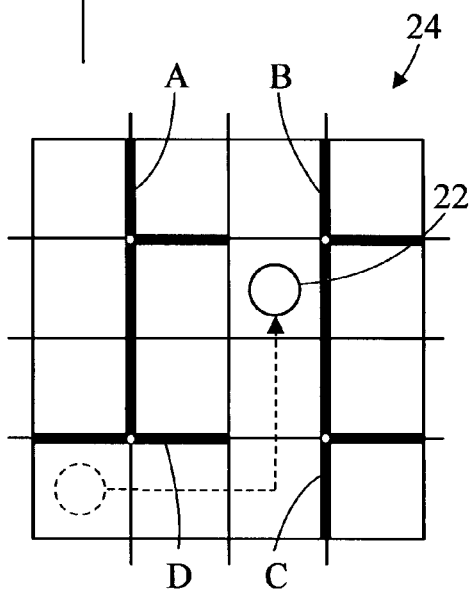
FIG. 9 is the playing area of FIG. 8 showing a move by a playing piece.
Figure 10:
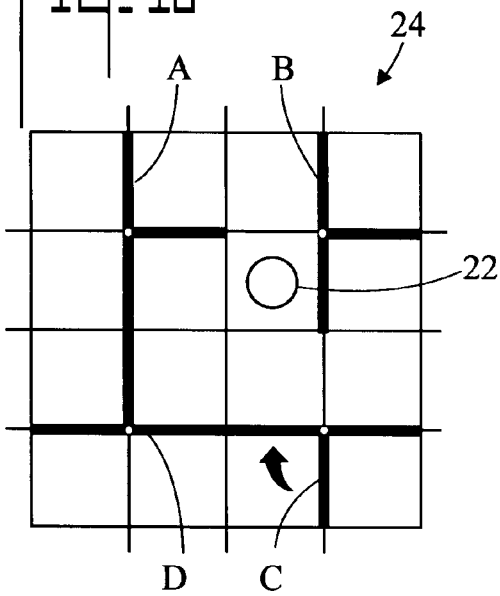
FIG. 10 is the playing area of FIG. 9 showing the rotation of a rotatable gate member.

FIG. 8 is an enlarged fragmented top plan view of playing area 24 showing 16 playing stations 30, one game piece 22 (white), and four rotatable gate members 34 and their four associated pivot points 36. For discussion purposes the four rotatable gate members 34 are labeled A, B, C, and D. FIGS. 9 and 10 are subsequent views of FIG. 8 after a player has moved his/her game piece 22 and rotated a rotatable gate member(s) 34. The player has used the first M and second R randomizers to determine the number of playing stations 30 his/her game piece may move, and the number of one-quarter turns which may be made by one or more rotatable gate members 34. In the shown example, first randomizer M equals four, and second randomizer R equals one. That is, the player has rolled the M and R dice with a result of four and one respectively. Therefore the player may move his/her game piece 22 four playing stations 30, and may rotate a rotatable gate member 34 one-quarter turn.

FIG. 9 is the playing area 24 of FIG. 8 showing a move by a game piece 22. The player has moved his/her game piece 22 four playing stations 30 from the initial position shown in FIG. 8 (dashed) to the new position shown in FIG. 9, as is determined by the M value of four. It is noted that game pieces 22 may not jump over (or move through) a gate 38 of a rotatable gate member 34.

FIG. 10 is the playing area 24 of FIG. 9 showing the rotation of a rotatable gate member 34. Rotatable gate member C has been rotated one-quarter turn clockwise, as is determined by the R value of one.

Figure 11:
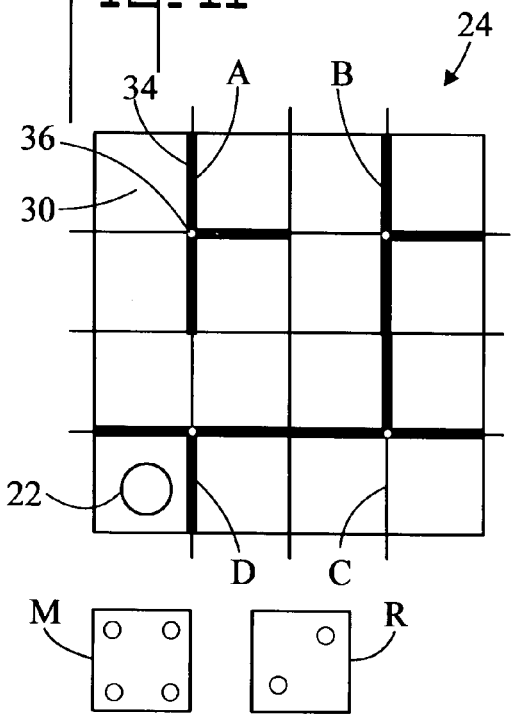
FIG. 11 is an enlarged fragmented top plan view of a playing area.
Figure 12:
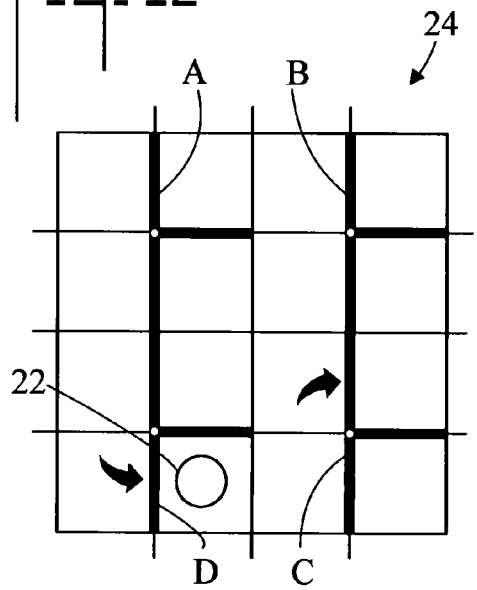
FIG. 12 is the playing area of FIG. 11 showing the rotation of two rotatable gate members.
Figure 13:
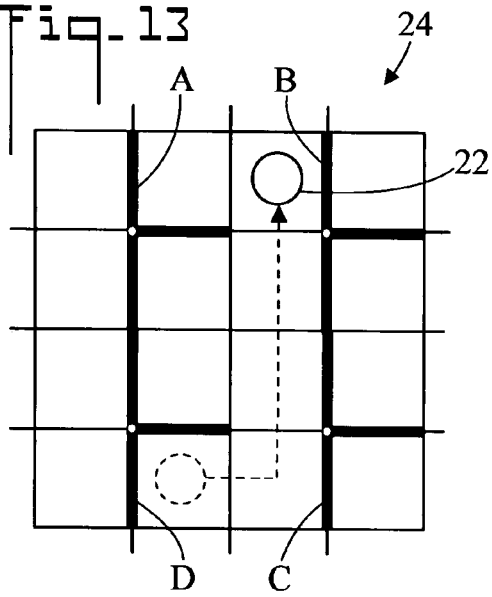
FIG. 13 is the playing area of FIG. 12 showing a move by a playing piece.

FIG. 11 is an enlarged fragmented top plan view of playing area 24 showing 16 playing stations 30, one game piece 22 (white), and four rotatable gate members 34 and their four associated pivot points 36. For discussion purposes the four rotatable gate members 34 are labeled A, B, C, and D. FIGS. 12 and 13 are subsequent views of FIG. 11 after a player has rotated a rotatable gate member(s) 34 and moved his/her game piece 22. In this example, first randomizer M equals four, and second randomizer R equals two.

FIG. 12 is the playing area of FIG. 11 showing rotatable gate member D rotated one-quarter turn (90°) counter-clockwise and rotatable gate member C rotated one-quarter turn (90°) clockwise, as is determined by a R value of two. It is noted that rotatable gate member D moves game piece 22 as shown.

FIG. 13 is the playing area of FIG. 12 showing game piece 22 moved four playing stations 30, as is determined by a M value of four.

Figure 14:
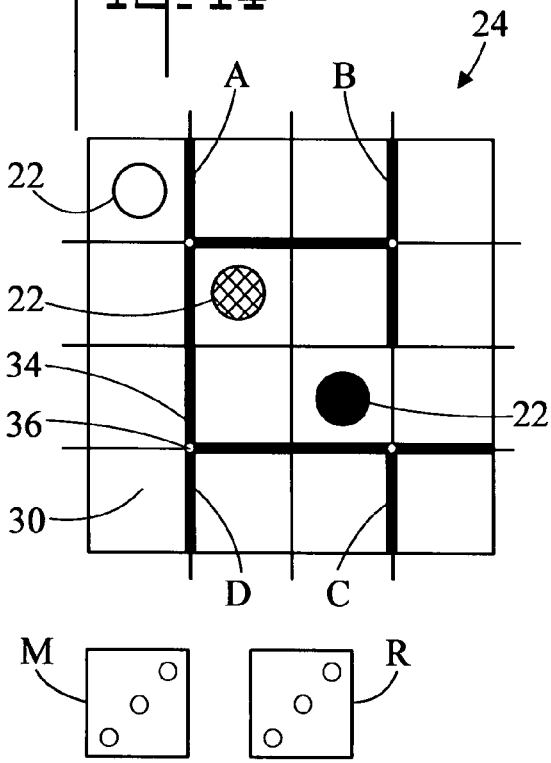
FIG. 14 is an enlarged fragmented top plan view of a playing area.
Figure 15:
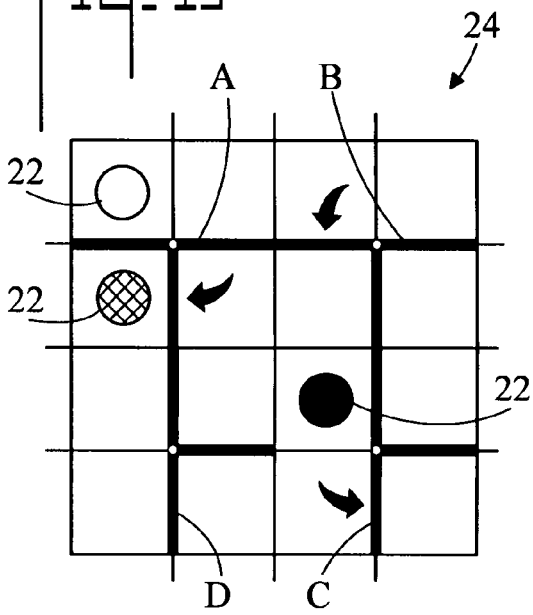
FIG. 15 is the playing area of FIG. 14 showing the rotation of three rotatable gate members.
Figure 16:
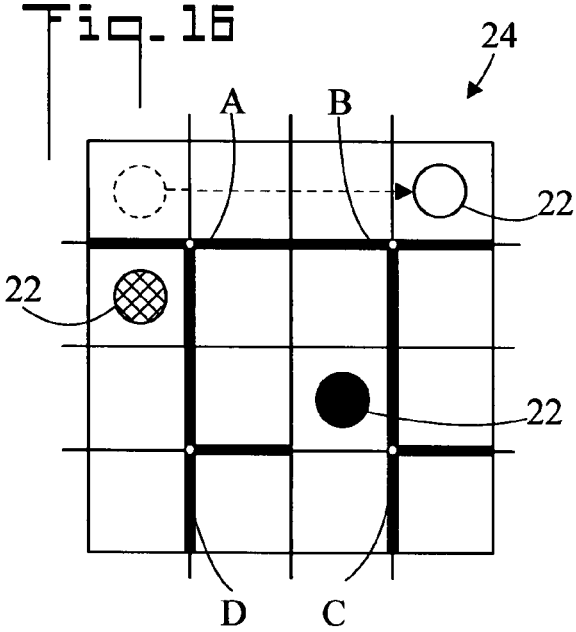
FIG. 16 is the playing area of FIG. 15 showing a move by a playing piece.

FIG. 14 is an enlarged fragmented top plan view of playing area 24 showing 16 playing stations 30, three game pieces 22 (white, hatched, and black respectively for three players), and four rotatable gate members 34 (refer to FIG. 2) and their four associated pivot points 36. For discussion purposes the four rotatable gate members 34 are labeled A, B, C, and D. FIGS. 15 and 16 are subsequent views of FIG. 14 after a player has rotated a rotatable gate member(s) 34 and moved his/her game piece 22. In this example, it is the turn of the player with white game piece 22, and he/she rolls three (M) and three (R).

FIG. 15 is the playing area of FIG. 14 showing rotatable gate member A rotated one-quarter turn clockwise, rotatable gate member B rotated one-quarter turn counter-clockwise, and rotatable gate member C rotated one-quarter turn counter-clockwise. Note that rotatable gate member A moves game piece 22 (hatched)

FIG. 16 is the playing area of FIG. 15 showing game piece 22 (white) moved three playing stations 30.

Figure 17:
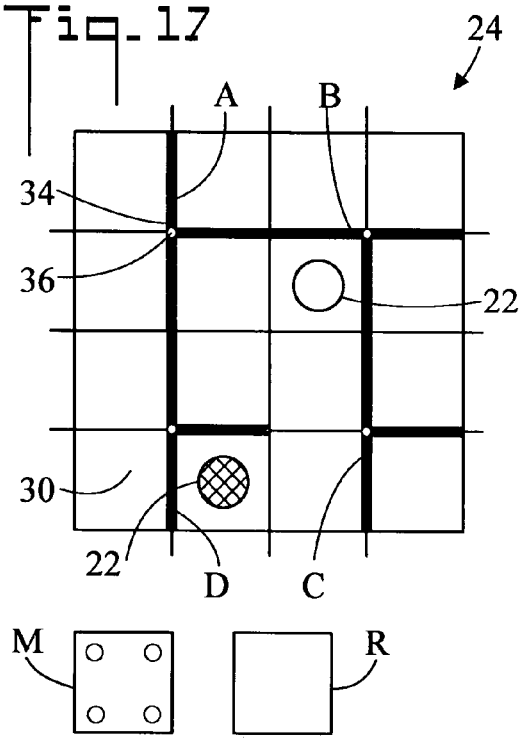
FIG. 17 is an enlarged fragmented top plan view of a playing area.
Figure 18:
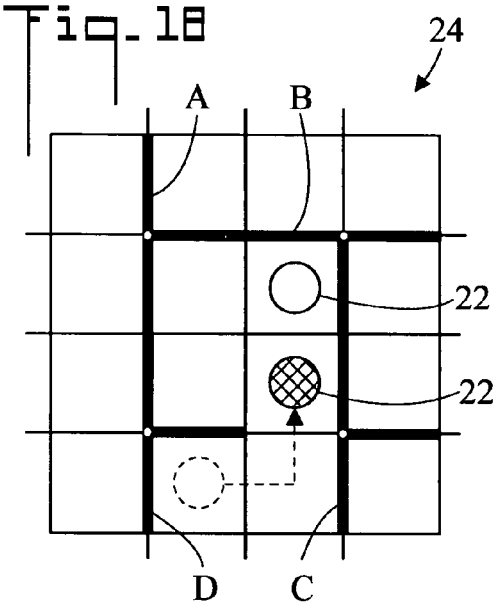
FIG. 18 is the playing area of FIG. 17 showing a move by a playing piece.

FIG. 17 is an enlarged fragmented top plan view of playing area 24 showing 16 playing stations 30, two game pieces 22 (white and hatched), and four rotatable gate members 34 and their four associated pivot points 36. For discussion purposes the four rotatable gate members 34 are labeled A, B, C, and D. FIG. 18 is a subsequent view of FIG. 17 after a player has moved his/her game piece 22. In this example, it is the turn of the player with hatched game piece 22, and he/she rolls four (M) and zero (R).

FIG. 18 is the playing area of FIG. 17 showing game piece 22 (hatched) only able to move two (not four) playing stations 30 since the third playing station 30 is occupied by the game piece 22 of another player, and the fourth playing station 30 is blocked by a gate.

Figure 19:
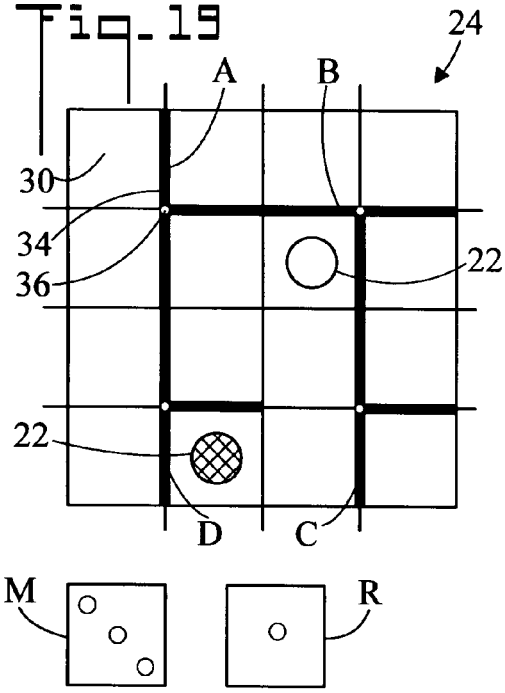
FIG. 19 is an enlarged fragmented top plan view of a playing area.
Figure 20:
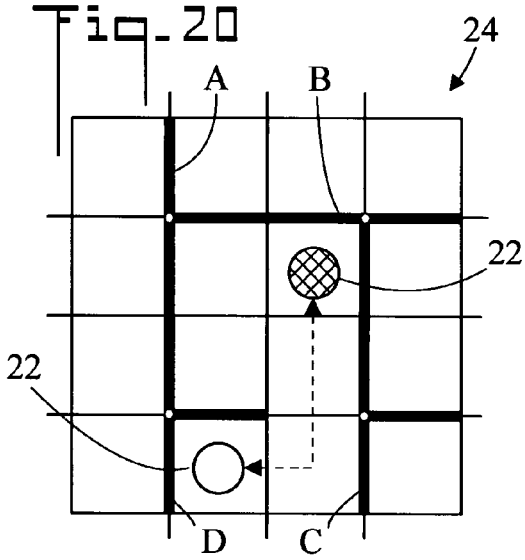
FIG. 20 is the playing area of FIG. 19 showing a move by a playing piece; and, FIG. 21 is the playing area of FIG. 20 showing the rotation of a rotatable gate member.
Figure 21:
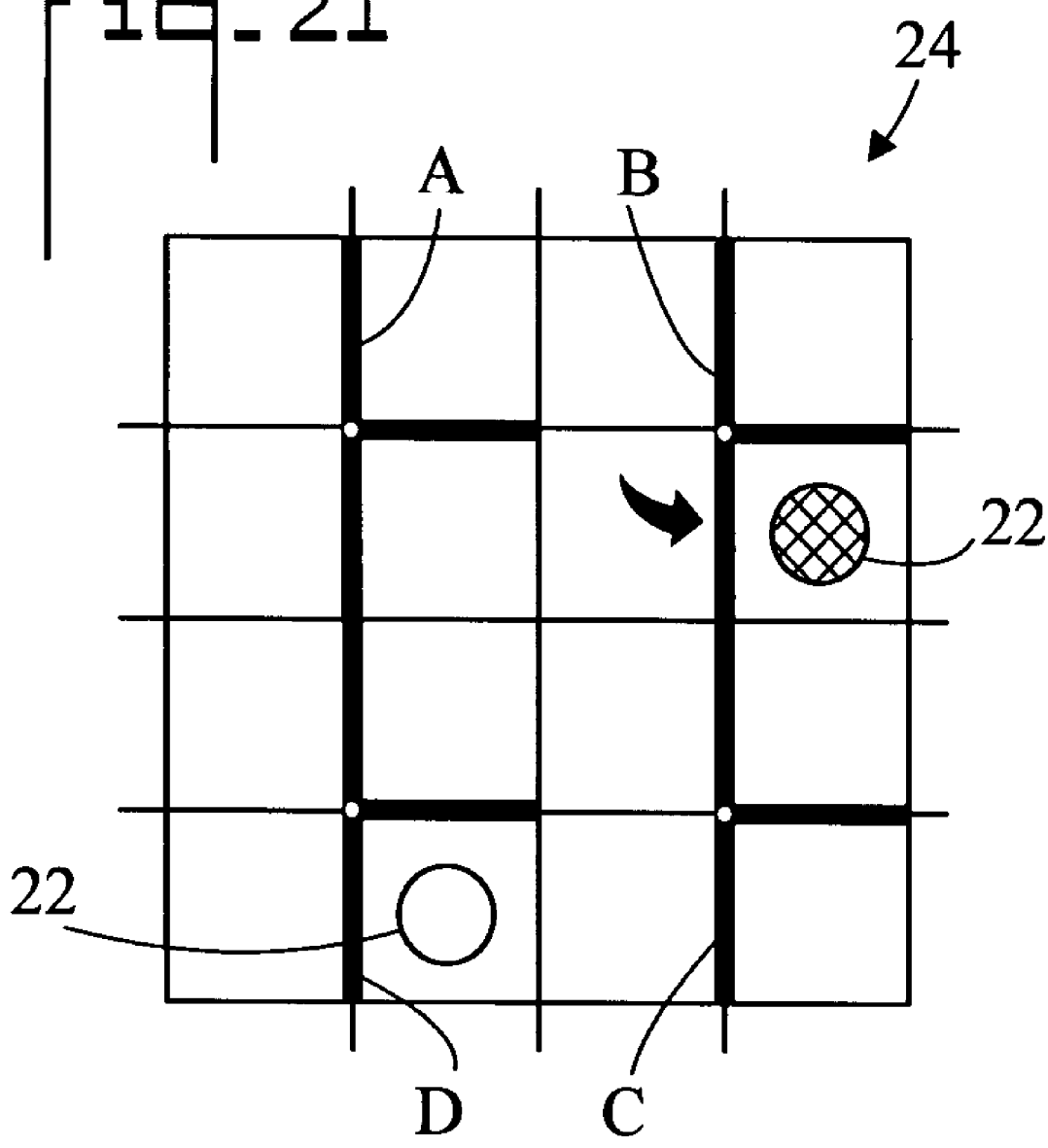

FIG. 19 is an enlarged fragmented top plan view of playing area 24 showing 16 playing stations 30, two game pieces 22 (white and hatched), and four rotatable gate members 34 and their four associated pivot points 36. For discussion purposes the four rotatable gate members 34 are labeled A, B, C, and D. FIGS. 20 and 21 are subsequent views of FIG. 19 after a player has moved his/her game piece 22 and rotated a rotatable gate member 34. In this example, it is the turn of the player with hatched game piece 22, and he/she rolls three (M) and one (R).

FIG. 20 is the playing area of FIG. 19 showing hatched game piece 22 moved three playing stations 30 so that it lands on the playing station 30 occupied by the white game piece 22. If a game piece 22 lands on a playing station occupied by the game piece 22 of an opponent, and to do so 'uses the complete number of playing stations 30 as determined by first randomizer M, then the opponents game piece is moved back the same number of playing stations 30. In the shown example, the game opponent's game piece 22 (white) is moved back to the playing station 30 originally occupied by the player's game piece 22 (hatched). However, the opponent's game piece 22 could also be move to another playing station 30 so long as it does not jump over a gate.

FIG. 21 rotatable gate member B is rotated one-quarter turn counter-clockwise thereby moving hatched game piece 22 as shown.

RULES FOR PLAYING THE GAME: (refer to FIGS. 1 and 2)

Object of the Game: To be the first player to move his/her game piece 22 into the finish area 28.

Setup: Playing area 24 consists of a start area 26, a plurality of playing stations 30 upon which game pieces 22 are moved, a finish area 28, a plurality of rotatable gate members 34, a plurality of non-rotatable barricades 40, a first randomizer M (red die), and a second randomizer R (green die), and a game piece 22 for each player.

Start:

All players place their game pieces 22 on the start area 26.

Player with highest roll of the red die goes first.

Players can move from the start area 26 onto any adjacent playing station 30.

A player rolls both dice to move.

Moving:

- Game pieces 22 may only be moved parallel to the grid of playing stations 30 (not diagonally).
- Game pieces 22 cannot jump over a gate 38 of a rotatable gate member 34, but can jump over another game piece 22 while utilizing that game piece's space in the entirety of its move.
- The red die indicates the number of playing stations 30 to be moved.
- The green die indicates the total number of ¼ turns of the rotatable gate members 34 the player can make.
- Players may move their game pieces 22 the number of playing stations 30 first or turn the rotatable gate members 34 first, but a player may not turn part of the allotted rotatable gate members 34 before his/her game piece 22 is moved and then turn the rest after, nor may a player move part of the allocated playing stations 30, turn a rotatable gate member(s) 34, then move the rest of the playing stations 30.
- Players may use all or part of the allotted number of one-quarter turns of the rotatable gate members shown on the green die.
- A player can move a game piece 22 with a rotatable gate member 34 if the gate 38 forces the game piece 22 to move with it (but not onto an opponent's occupied space, see below). The movement of the game piece 22 with the gate 38 of the rotatable gate member 34 does not count as a move from the red/move die. Both the player's game piece 22 or an opponent's game piece 22 can be moved with a gate.

Players may move their game piece 22 all or part of the allotted number of moves shown on the red die. A lesser number may result if the game piece 22 is blocked by a gate, and may even result in no move at all.

No move can result in two game pieces 22 occupying the same playing station 30 (i.e. turning a gate to move pieces together, or simply moving onto the same playing station 30). However, a player's game piece 22 can land on a playing station 30 which is occupied by an opponent's game piece 22 by moving the complete number of playing stations 30 on the red/move die. If in a complete move, a player's game piece 22 lands on a playing station 30 which is occupied by an opponent's game piece 22, the player can move the opponent's game piece 22 back a number of playing stations 30 equal to the number on the red die, but cannot move the opponent's game piece 22 over any closed gates.

A player's game piece 22 cannot land on a playing station 30 which is occupied by an opponent's game piece 22 by moving only a portion of the playing stations 30 indicated on the red die, nor by having a gate push his/her game piece 22 onto a playing station 30 occupied by an opponent's game piece 22. If that player cannot move his/her game piece 22 beyond the opponent's game piece 22 because of a closed gate, then his/her game piece 22 must stop in the playing station 30 immediately before the one occupied by the opponent's game piece 22.

If a player's game piece lands on a blue square, then the player may roll again. (refer to hatched playing stations 31 on FIG. 1)

Finish: The first player to move his/her game piece 22 into finish area 28 wins the game.

In terms of use, a method for a plurality of players to play a maze game, includes:

(a) providing a maze game 20 including:

a game piece 22 for each of the plurality of players;

a playing area 24;

a plurality of playing stations 30 disposed upon playing area 24, the playing stations arranged to form a grid;

playing area 24 including a start area 26 and a finish area 28;

a plurality of rotatable gate members 34 disposed on playing area 24 wherein each rotatable gate member 34 rotates about a pivot point 36 which is disposed at a junction of four playing stations 30, and each rotatable gate member 34 includes at least one gate 38 outwardly projecting from pivot point 36;

a first randomizer M for determining the number of playing stations 30 a game piece 22 moves upon playing area 24; and, a second randomizer R for determining the rotation of rotatable gate members 34;

(b) the players placing their game pieces 22 upon start area 26;

(c) using the first M and second R randomizers, the plurality of players taking turns (1) moving their game pieces 22 upon playing area 24, and (2) rotating the rotatable gate members 34; and, (d) continuing with step (c) until a player's game piece 22 reaches finish area 28 wherein the player wins the game.

The method further including:

in step (a), at least one rotatable gate member 34 having three gates 38, wherein two of the three gates 38 are collinear and outwardly project in opposite directions from pivot point 36, and a third gate 38 is perpendicular to the two collinear gates 36;

the playing stations 30 being square and having four sides 32 each side 32 having a length L;

the three gates 38 also having a length L; and, pivot points 36 for two adjacent rotatable gate members 34 being disposed a distance of 2 L apart.

The method further including:

in step (a), playing area 24 being rectangular; and, start area 26 disposed at a corner of playing area 24, and finish area 28 disposed at a corner diagonally opposite start area 26.

The method further including:

in step (c), game pieces 22 may be moved and rotatable gate members 34 rotated only in accordance with one of the following, (1) the game piece 22 is moved first and after the game piece 22 move is completed one or more of the rotatable gate members 34 may be rotated, or (2) one or more of the rotatable gate members 34 are rotated first and after the rotation is completed the game piece 22 is moved. That is game piece 22 must be completely moved and then rotatable gate members 34 rotated, or rotatable gate members 34 completely rotated and then game piece 22 moved.

The method further including:

in step (c), when a said rotatable gate member is rotated, if a game piece 22 is disposed in a playing station 30 through which gate 38 of rotatable gate member 34 passes, the game piece 22 is moved to an adjacent playing station 30.

The method further including:

in step (c), second randomizer R determining a total number of one-quarter turns which may be made by one or more rotatable gate members 34.

The method further including:

in step (c), if a player's game piece 22 lands upon a playing station 30 occupied by an opponent's game piece 22 after moving a complete number of playing stations 30 indicated by first randomizer M, then the opponent's game piece 22 is moved back by the same number of playing stations 30.

The method further including:

in step (a) and before step (c), the rotatable gate members 34 being arranged in a random rotational position.

The preferred embodiments of the invention described herein are exemplary and numerous modifications, variations, and rearrangements can be readily envisioned to achieve an equivalent result, all of which are intended to be embraced within the scope of the appended claims.

I claim:

1. A maze game for a plurality of players, comprising:

a game piece for each of the plurality of players;

a playing area;

a plurality of playing stations disposed upon said playing area, said playing stations arranged to form a grid;

a plurality of rotatable gate members disposed on said playing area;

each said rotatable gate member rotatable about a pivot point which is disposed at a junction of four said playing stations;

each said rotatable gate member including three gates which outwardly project from said pivot point, wherein two of said three gates are collinear and outwardly project in opposite directions, and a third said gate is oriented perpendicular to said two collinear gates.

2. The maze game according to claim 1, further including:
when a said rotatable gate member is rotated, if a game piece is disposed in a playing station through which said gate of said rotatable gate member passes, said game piece is moved to an adjacent playing station.

3. The maze game according to claim 1, further including:
said playing area being rectangular and having four corners;
said playing area including a start area which initially receives all said game pieces, and a finish area;
said start area disposed at a said corner of said playing area, and said finish area disposed at another said corner of said playing area diagonally opposite said start area; and,
said start area and said finish area each including four playing stations.

4. The maze game according to claim 1, further including:
a first randomizer for determining the number of playing stations a said game piece moves upon said playing area; and,
a second randomizer for determining the amount of rotation of said rotatable gate members about said pivot point.

5. The maze game according to claim 4, further including:
said second randomizer determining a total number of one-quarter turns which may be made by one or more said rotatable gate members.

6. The maze game according to claim 4, further including:
said second randomizer including a six sided die having a representation of the number zero on one side, a representation of the number one on one side, a representation of the number two on two sides, a representation of the number three on one side, and a representation of the number four on one side.

7. The maze game according to claim 1, further including:
at least one non-rotatable barricade disposed upon said playing area;
said barricade disposed at a junction of four said playing stations; and,
said barricade having four outwardly projecting gates which are spaced at 90° intervals and which are aligned with said grid.

8. The maze game according to claim 1, further including:
said playing stations being square and having four sides each said side having a length L;
said gate also having a length L;
said pivot points for two adjacent said rotatable gate members being disposed a distance of 2 L apart;
each said rotatable gate member being rotatable to one of four positions, wherein each position is 90° from an adjacent position;
said playing area being rectangular;
said playing area including a start area and a finish area;
said start area disposed at a corner of said playing area, and said finish area disposed at a diagonally opposite corner of said playing;
a first randomizer for determining the number of playing stations a said game piece moves upon said playing area;
a second randomizer for determining the amount of rotation of said rotatable gate members;
said second randomizer determining a total number of one-quarter turns which may be made by one or more said rotatable gate members;
said second randomizer including a six sided die having a representation of the number zero on one side, a representation of the number one on one side, a representation of the number two on two sides, a representation of the number three on one side, and a representation of the number four on one side;
at least one non-rotatable barricade disposed upon said playing area;
said barricade disposed at a junction of four said playing stations; and,
said barricade having four outwardly projecting gates which are spaced at 90° intervals and which are aligned with said grid.

9. A method for a plurality of players to play a maze game, comprising:
(a) providing a maze game, said maze game including:
a game piece for each of the plurality of players;
a playing area;
a plurality of playing stations disposed upon said playing area, said playing stations arranged to form a grid;
said playing area including a start area and a finish area;
a plurality of rotatable gate members disposed on said playing area;
each said rotatable gate member rotatable about a pivot point which is disposed at a junction of four said playing stations;
each said rotatable Sate member including three gates which outwardly project from said pivot point, wherein two of said three gates are collinear and outwardly project in opposite directions, and a third said gate is oriented perpendicular to said two collinear
a first randomizer for determining the number of playing stations a said game piece moves upon said playing area; and,
a second randomizer for determining the amount of rotation of said rotatable gate members about said pivot point;
(b) the players placing their said game pieces upon said start area;
(c) using said first and second randomizers, the plurality of players taking turns (1) moving their game pieces upon said playing area, and (2) rotating said rotatable gate members; and,
(d) continuing with step (c) until a player's game piece reaches said finish area wherein the player wins the game.

10. The method according to claim 9, further including:
in step (a), said playing area being rectangular and having four corners;
said start area disposed at a said corner of said playing area, and said finish area disposed at another said corner of said playing area diagonally opposite said start area; and
said start area and said finish area each including four playing stations.

11. The method according to claim 9, further including:
in step (c), when a said rotatable gate member is rotated, if a game piece is disposed in a playing station through which said gate of said rotatable gate member passes, said game piece is moved to an adjacent playing station.

12. The method according to claim 9, further including:
in step (c), said second randomizer determining a total number of one-quarter turns which may be made by one or more said rotatable gate members.

13. The method according to claim 9, further including:
in step (c), if a player's said game piece lands upon a said playing station occupied by an opponent's said game piece after moving a complete number of said playing stations indicated by said first randomizer, then the opponent's game piece is moved back by the same number of playing stations.

14. The method according to claim 9, further including:

in step (a) and before step (c), said rotatable gate members being arranged in a random rotational position.

15. The method according to claim 9, further including:

in step (c), a player not being able to rotate a portion of said second randomizer amount before said game piece is moved and the remaining portion of said second randomizer amount after said game piece is moved.

16. The method according to claim 9, further including:

in step (c), when a said rotatable gate member is rotated, if a game piece is disposed in a playing station through which said gate of said rotatable gate member passes, said game piece is moved to an adjacent playing station; and, said move of said game piece by said gate not included in said number of playing stations determined by said first randomizer.

* * * * *

UNITED STATES PATENT AND TRADEMARK OFFICE

CERTIFICATE OF CORRECTION

PATENT NO. : 7,527,266 B1
APPLICATION NO. : 11/713850
DATED : May 5, 2009
INVENTOR(S) : Dominic Laiti It is certified that error appears in the above-identified patent and that said Letters Patent is hereby corrected as shown below:

Col. 10, Claim 9, line 24, step (a), clause seven should read:

--each said rotatable ~~Sate~~ gate member including three gates which outwardly project from said pivot point, wherein two of said three gates are collinear and outwardly project in opposite directions, and a third said gate is oriented perpendicular to said two collinear gates;--

Signed and Sealed this

Fourteenth Day of July, 2009

JOHN DOLL
*Acting Director of the United States Patent and Trademark Office*